US010626782B2

(12) United States Patent
Gerlich

(10) Patent No.: US 10,626,782 B2
(45) Date of Patent: Apr. 21, 2020

(54) HOUSING, ESPECIALLY FOR AN EXHAUST SYSTEM OF AN INTERNAL COMBUSTION ENGINE OF A VEHICLE

(71) Applicant: Eberspächer Exhaust Technology GmbH & Co. KG, Neunkirchen (DE)

(72) Inventor: Harald Gerlich, Schiffweiler (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 72 days.

(21) Appl. No.: 15/956,069

(22) Filed: Apr. 18, 2018

(65) Prior Publication Data

US 2018/0306093 A1 Oct. 25, 2018

(30) Foreign Application Priority Data

Apr. 19, 2017 (DE) ..... 10 2017 108 244

(51) Int. Cl.
*F01N 13/18* (2010.01)

(52) U.S. Cl.
CPC ..... *F01N 13/185* (2013.01); *F01N 13/1872* (2013.01); *F01N 13/1888* (2013.01); *F01N 13/1894* (2013.01)

(58) Field of Classification Search
CPC ..... F01N 13/185; F01N 13/1872; F01N 13/1877; F01N 13/1888; F01N 13/1894
See application file for complete search history.

(56) References Cited

U.S. PATENT DOCUMENTS 4,441,241 A * 4/1984 Hoeffken ..... F24H 3/105 165/170
5,280,142 A * 1/1994 Keller ..... F01N 13/14 126/83
2018/0252143 A1* 9/2018 Schliesche ..... F01N 13/1805

FOREIGN PATENT DOCUMENTS

DE 913 600 C 6/1954
DE 10 2005 044376 A1 3/2007
DE 202013004290 U1 * 6/2013 ..... F16L 59/028
DE 20 2013 004 290 U1 8/2013

* cited by examiner

*Primary Examiner* — Audrey K Bradley
(74) *Attorney, Agent, or Firm* — McGlew and Tuttle, P.C.

(57) ABSTRACT

A vehicle, internal combustion engine, exhaust system, housing includes housing shell areas (10, 12), which are connected together in a folded connection area (32). The folded connection area includes a folded edge area (20, 22), extending along a folded edge longitudinal axis (L), and a plurality of spaced apart crimped sections (24, 26), which extend essentially at right angles to the folded edge longitudinal axis (L) and away from the folded edge area (20, 22) and provide intermediate spaces (28, 30). Some of the crimped sections (24, 26), of one housing shell area mesh with an intermediate space formed between two crimped sections (24, 26) of another housing shell area and overlap the folded edge area (20, 22) of the other housing shell area (10, 12) such that the folded edge area (20, 22) of the other housing shell area (10, 12) is held between the crimped sections (24, 26).

19 Claims, 6 Drawing Sheets

HOUSING, ESPECIALLY FOR AN EXHAUST SYSTEM OF AN INTERNAL COMBUSTION ENGINE OF A VEHICLE

CROSS REFERENCE TO RELATED APPLICATIONS

This application claims the benefit of priority under 35 U.S.C. § 119 of German Application 10 2017 108 244.1, filed Apr. 19, 2017, the entire contents of which are incorporated herein by reference.

FIELD OF THE INVENTION

The present invention pertains to a housing, especially for an exhaust system of an internal combustion engine of a vehicle.

BACKGROUND OF THE INVENTION

The housings used in exhaust gas treatment units of exhaust systems in vehicles are made, in general, of sheet metal material, which is shaped such that housing shell areas of a housing shell or of different housing shells, which adjoin each other in a connection area, are connected to one another by shaping, for example, by hemming, and/or by connection in substance, for example, welding.

SUMMARY OF THE INVENTION

An object of the present invention is to provide a housing, especially for an exhaust system of an internal combustion engine of a vehicle, in which housing shell areas can be connected to one another in a simple and stable manner to provide a closed configuration of the housing.

This object is accomplished according to the present invention by a housing, especially for an exhaust system of an internal combustion engine of a vehicle, comprising at least two housing shell areas connected to one another in at least one folded connection area, wherein, to provide the folded connection area, each housing shell area comprises a folded edge area extending in a fold longitudinal direction and a plurality of crimped sections, which extend essentially at right angles to the folded edge longitudinal direction away from the folded edge area and are arranged at spaced locations from one another to provide an intermediate space in the folded edge longitudinal axis, wherein at least some of each of the housing shell areas meshes with an intermediate space each formed between two crimped sections of the respective other housing shell area and overlaps the folded edge area of this other housing shell area such that the folded edge area of this other housing shell area is held between the crimped sections overlapping same and the folded edge area of the housing shell area having these crimped sections.

By providing crimped sections and intermediate spaces following each other alternatingly in the folded edge longitudinal axis, a tooth-like configuration is produced, which forces, on the one hand, a defined positioning of the housing shell areas to be connected to one another. On the other hand, it is guaranteed that the two housing shell areas are held together in a stable manner due to the mutual alternating meshing. Since an outer edge formed by crimping the crimped sections is formed essentially over the entire length of a folded connection area configured according to the present invention in case of a folded connection area configured according to the present invention, sharp-edged sections implying a risk of injury are avoided.

To achieve the holding together of the two housing shell areas contiguously, essentially without interruptions, in the folded edge longitudinal axis, it is proposed that the intermediate space formed between two crimped sections following one another in the folded edge longitudinal axis in each housing shell area have a length of extension in the folded edge longitudinal axis that corresponds essentially to a length of extension of the crimped sections of the respective other housing shell area, which crimped sections are received in this intermediate space. This means in the sense of the present invention that a respective crimped section can be received essentially without or with a small clearance of motion in the folded edge longitudinal axis between two crimped sections of the respective other housing shell area, but the crimped section can be inserted essentially without forcing or deformation into the intermediate space between the two crimped sections of the respective other housing shell area, which said crimped sections receive this crimped section between them.

To make it possible in this case to provide a symmetrical configuration of the two housing shell areas, a length of extension of the crimped sections may correspond in all housing shell areas essentially to a length of extension of the respective intermediate space formed between crimped sections following each other in the folded edge longitudinal axis.

To facilitate the assembly of the folded edge areas of the housing shell areas to be connected to one another, it is proposed that the crimped sections be configured with a taper beginning from the folded edge area in at least one and preferably each housing shell area. The crimped sections thus have, starting from the respective folded edge area, a length of extension decreasing in the folded edge longitudinal axis, so that a lead-in bevel is formed between two crimped sections following each other in the folded edge longitudinal axis for a crimped section of a respective other housing shell area, which said crimped section is to be received between these crimped sections.

A configuration that can be prepared in an especially simple manner can be provided by the folded edge area being configured as an essentially flat, contiguous area in the folded edge longitudinal axis in all housing shell areas. This means that, in the sense of the present invention, according to the configuration of the housing to be provided, a respective folded edge area may extend, for example, essentially linearly, or also with a curved course in case of a curved configuration of the housing, corresponding to this curved housing contour, but it has essentially no bulges at right angles to a likewise curved surface, which is defined by a respective folded edge area.

Provisions may be made in an alternative embodiment for the folded edge area to have a crimped section mounting recess in at least one and preferably each housing shell area associated with at least one and preferably each intermediate space formed between crimped sections following each other in the folded edge longitudinal axis in the folded edge longitudinal axis between the two crimped sections forming the intermediate space between them on its side facing away from the folded edge area of the respective other housing shell area. A crimped section overlapping a folded edge area thus meshes with a crimped section mounting recess, which supports, on the one hand, the centering of the two housing shell areas to be connected, and leads, on the other hand, to a reduced thickness of the folded connection area thus prepared.

To make it possible to receive in this case a respective crimped section essentially fully in a crimped section mounting recess associated therewith, it is proposed that the length of extension of a respective crimped section mounting recess in the folded edge longitudinal axis correspond essentially to the length of extension of a crimped section received in it, or/and that the depth of the recess of a respective crimped section mounting recess corresponds essentially to the thickness of the crimped section received in it.

Such crimped section mounting recesses may be provided in an especially simple manner by the folded edge area of one of the housing shell areas being deformed in the direction of the folded edge area of the respective other housing shell area.

The folded edge area may be bent in relation to a housing shell body adjoining this in at least one and preferably each housing shell area.

To make it possible, on the one hand, to achieve the deformability of the housing to be provided according to the present invention, which deformability is necessary for preparing the folded connection area, and to make it also possible, on the other hand, to make this housing especially also heat-resistant, it is proposed that at least one and preferably each housing shell area be made of a sheet metal material.

The housing shell areas may be in contact with one another by their folded edge areas.

The present invention pertains, furthermore, to an exhaust gas treatment unit for an exhaust system of an internal combustion engine, especially for a vehicle, comprising a housing configured according to the present invention.

The present invention will be described below in detail with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
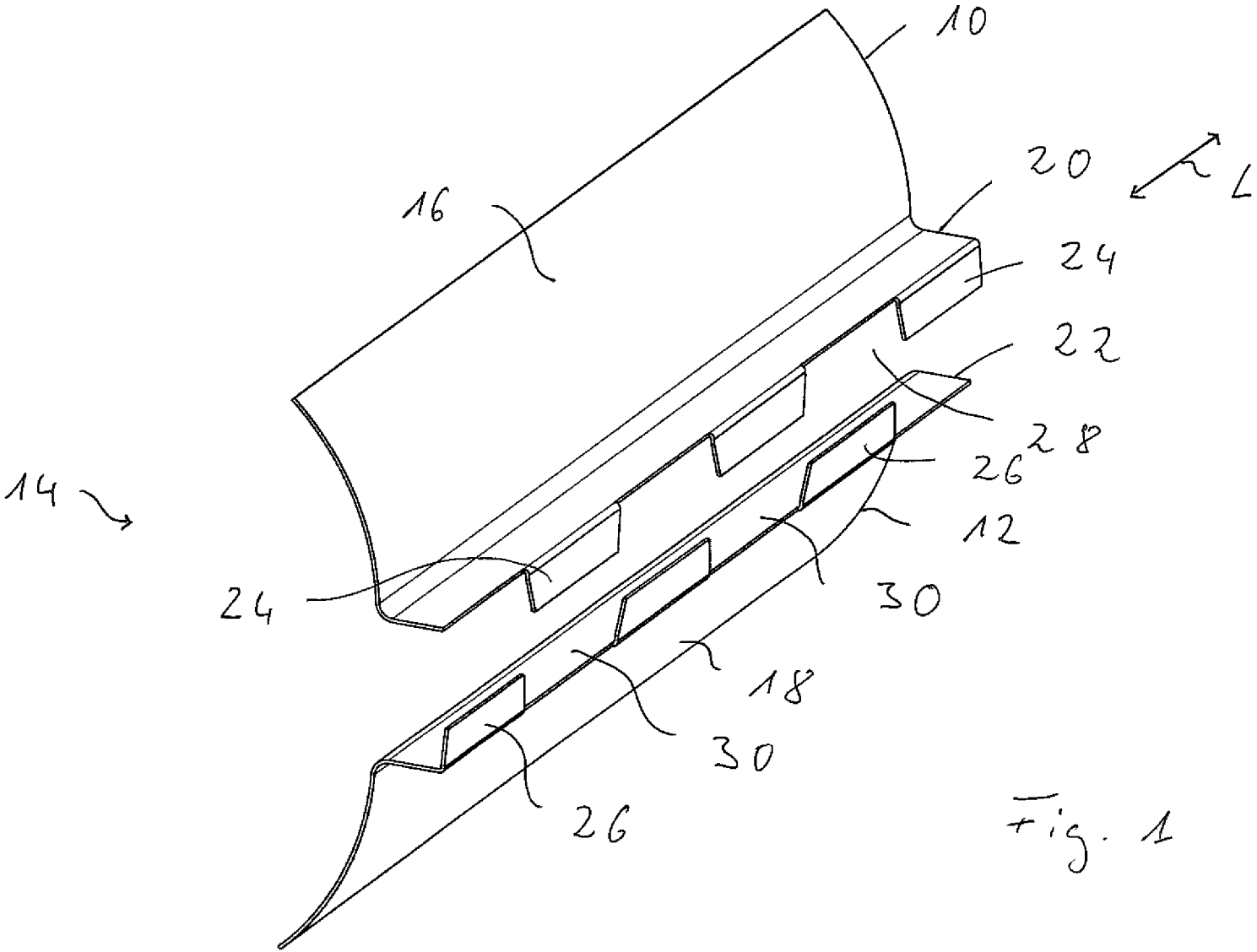
FIG. 1 is a perspective view of two housing shell areas to be connected to one another in a folded connection area.

Referring to the drawings, FIG. 1 shows two housing shell areas 10, 12 of a housing, generally designated by 14, of, for example, an exhaust gas treatment unit, for example, a catalytic converter or particle filter, of an exhaust system of an internal combustion engine in a vehicle, which said housing shell areas are to be connected to one another. The two housing shell areas 10, 12 are shaped from sheet metal material and may be, for example, areas of a housing shell bent in a ring-like configuration or may be areas of two housing shells, which are built separately and are to be connected to one another.

Each of the two housing shell areas 10, 12 has a, for example, curved housing shell body 16, 18, at which a respective folded edge area 20, 22, which is bent in relation to the respective housing shell body 16, 18 and passes through in a straight line and flatly in the example shown, is provided.

A plurality of crimped sections 24, 26 extend from the folded edge areas 20, 22, which extend along a folded edge longitudinal axis L, essentially at right angles to the folded edge longitudinal axis L and at an angle of approximately equaling or somewhat greater than 90°. A respective intermediate space 28 is formed between the crimped sections 24 extending from the folded edge area 20. A respective intermediate space 30 each is correspondingly formed between the crimped sections 26 extending from the folded edge area 22.

The length of extension of the crimped sections 24, 26 in the folded edge longitudinal axis L corresponds essentially to the length of extension of the respective intermediate spaces 28, 30 formed between these. The crimped sections 24, 26 may be configured in this case as tapering starting from the respective folded edge area 20, 22, so that their length of extension decreases along the folded edge longitudinal axis L, starting from the respective folded edge area 20, 22. The length of extension of the intermediate spaces 28, 30 formed between two such crimped sections 24 and 26, respectively, correspondingly then increases starting from the respective folded edge area 20, 22. The crimped sections 24 correspondingly form respective lead-in bevels at the folded edge area 20 for the respective crimped sections 26 to be received between these at the folded edge area 22 and vice versa.

Figure 2:
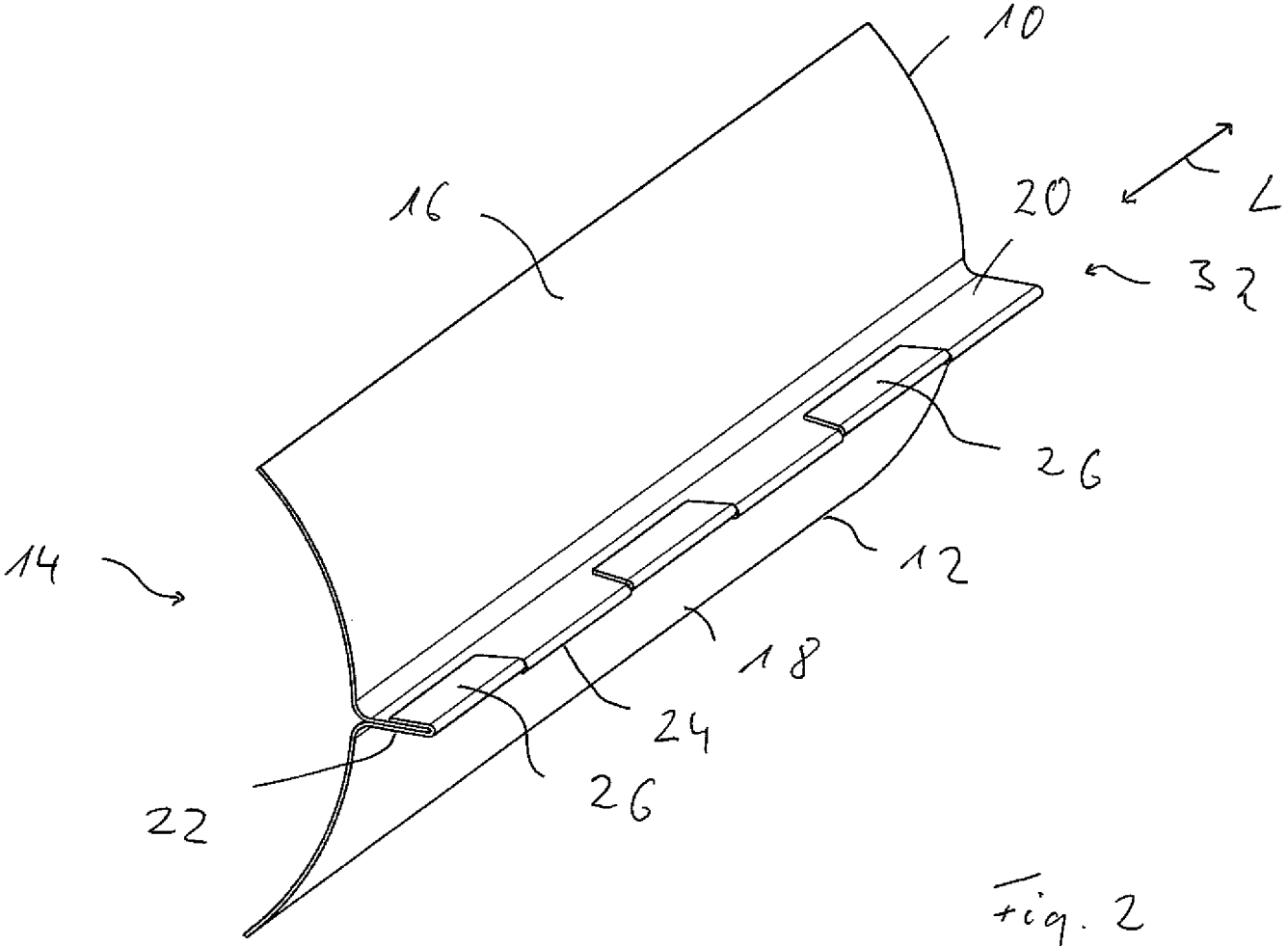
FIG. 2 is a perspective view of the two housing shell areas connected to one another in a folded connection area.
Figure 3:
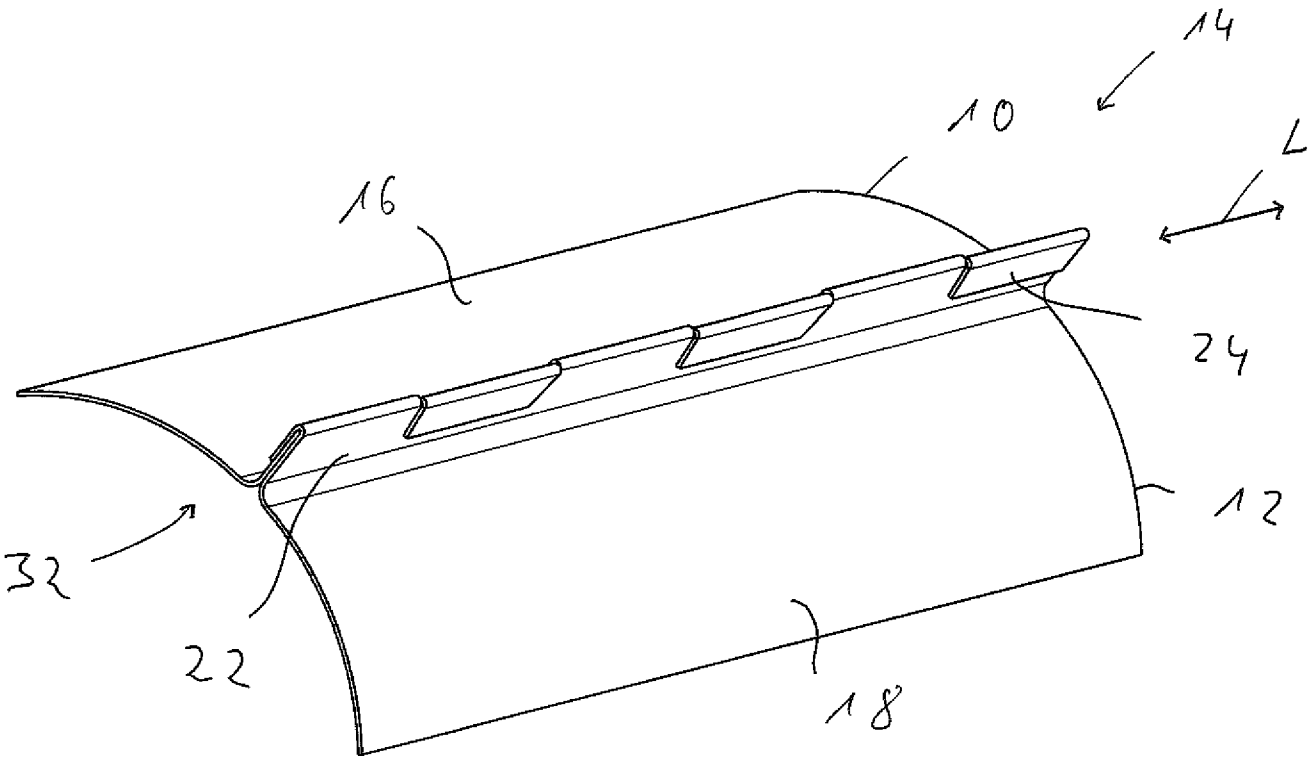
FIG. 3 is a perspective view, corresponding to the embodiment of FIG. 2, of the folded connection area, viewed in another direction.

To prepare a folded connection area 32 recognizable in FIGS. 2 and 3, the two housing shell areas 10, 12 with their two folded edge areas 20, 22 are positioned such that they overlap each other or are in contact with one another, such that the respective crimped sections 24, 26 extending away from these folded edge areas 20, 22 mesh with the intermediate spaces 38, 30 provided at the respective other housing shell area 10, 12. A defined positioning of the two folded edge areas 20, 22 is achieved in this manner in the folded edge longitudinal axis L in relation to one another, and a correspondingly defined positioning of the two housing shell areas 10, 12 in relation to one another is correspondingly achieved.

After the two housing shell areas 10, 12 are positioned in relation to one another in the above-described manner, the crimped sections 24, 26 are crimped further, so that the crimped sections 24 of the housing shell area 10 overlap the folded edge area 22 of the housing shell area 12 and this folded edge area 22 is thus held and clamped firmly between the folded edge area 20 of the housing shell area 10 and the crimped sections 24 provided at this housing shell area 10. The crimped sections 26 of the housing shell area 12 correspondingly over the folded edge area 20 of the housing shell area 10 after the further crimping, so that this folded edge area 20 is held and clamped firmly between the folded edge area 22 of the housing shell area 12 and the crimped sections 26 provided at this housing shell area 12.

It is ensured in the folded connection area 32 thus prepared in a simple manner that the two housing shell areas 10, 12 are held together along the folded edge longitudinal axis L essentially contiguously. The connection thus provided is stable and it may also be made gas-tight if the two folded edge areas 20, 22 are not directly in contact with one another but, for example, via the intermediary of a layer of sealing material. When manufacturing the two housing shell areas 10, 12, the respective folded edge area 20, 22 and the crimped sections 24, 26, which project from this in a bent shape, can be provided in a simple manner, for example, when a punching operation and a shaping operation following this are carried out, so that the crimped sections 24, 26, which mesh with one another in a tooth-like manner, can be folded over further by a tool having a simple configuration and thus they can position the folded edge area of the respective other housing shell area in an overlapping manner to prepare the folded connection area 32.

Figure 4:
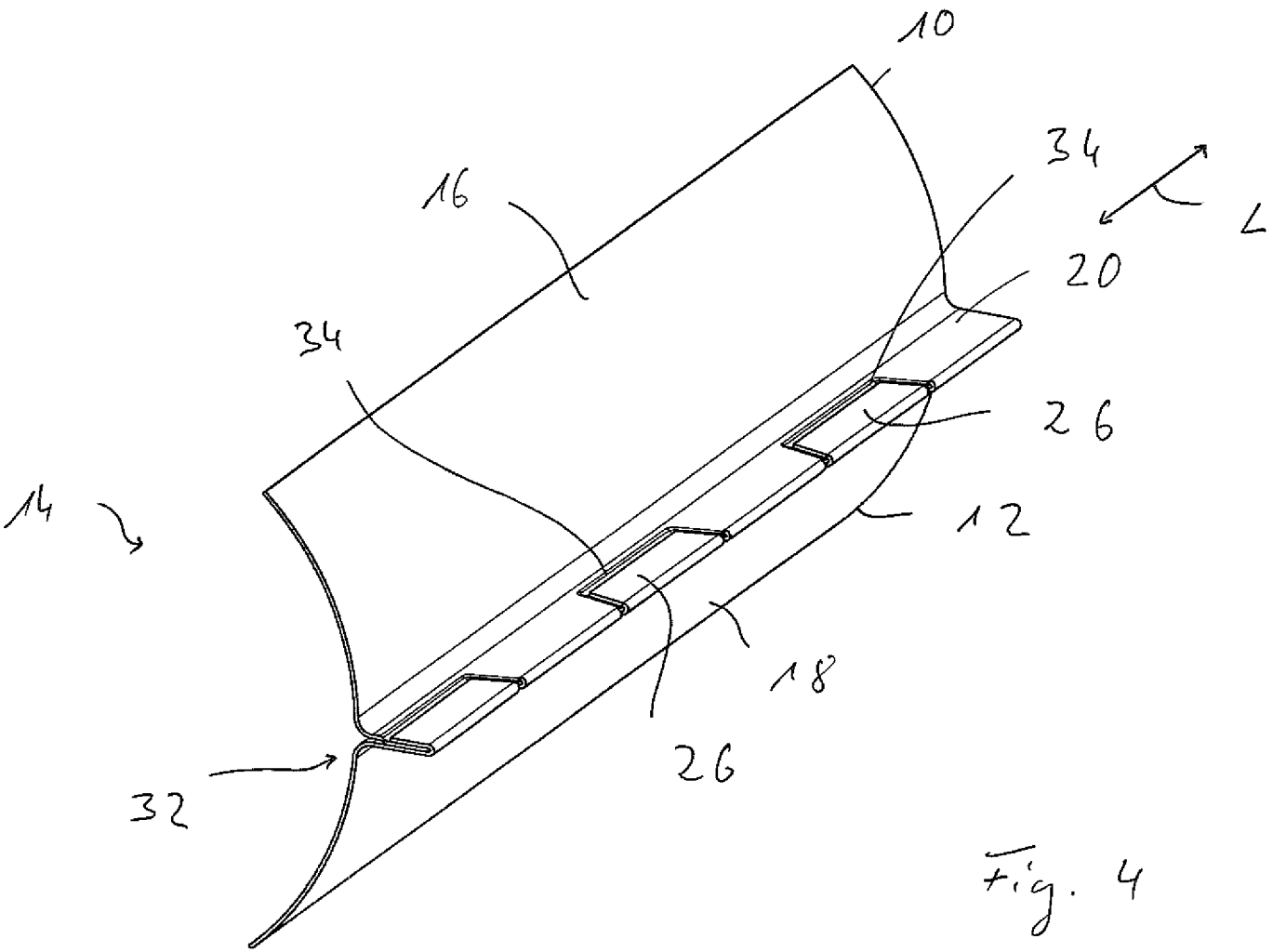
FIG. 4 is a perspective view, with an orientation corresponding to FIG. 2, of two housing shell areas connected to one another in a folded connection area having an alternative configuration.
Figure 5:
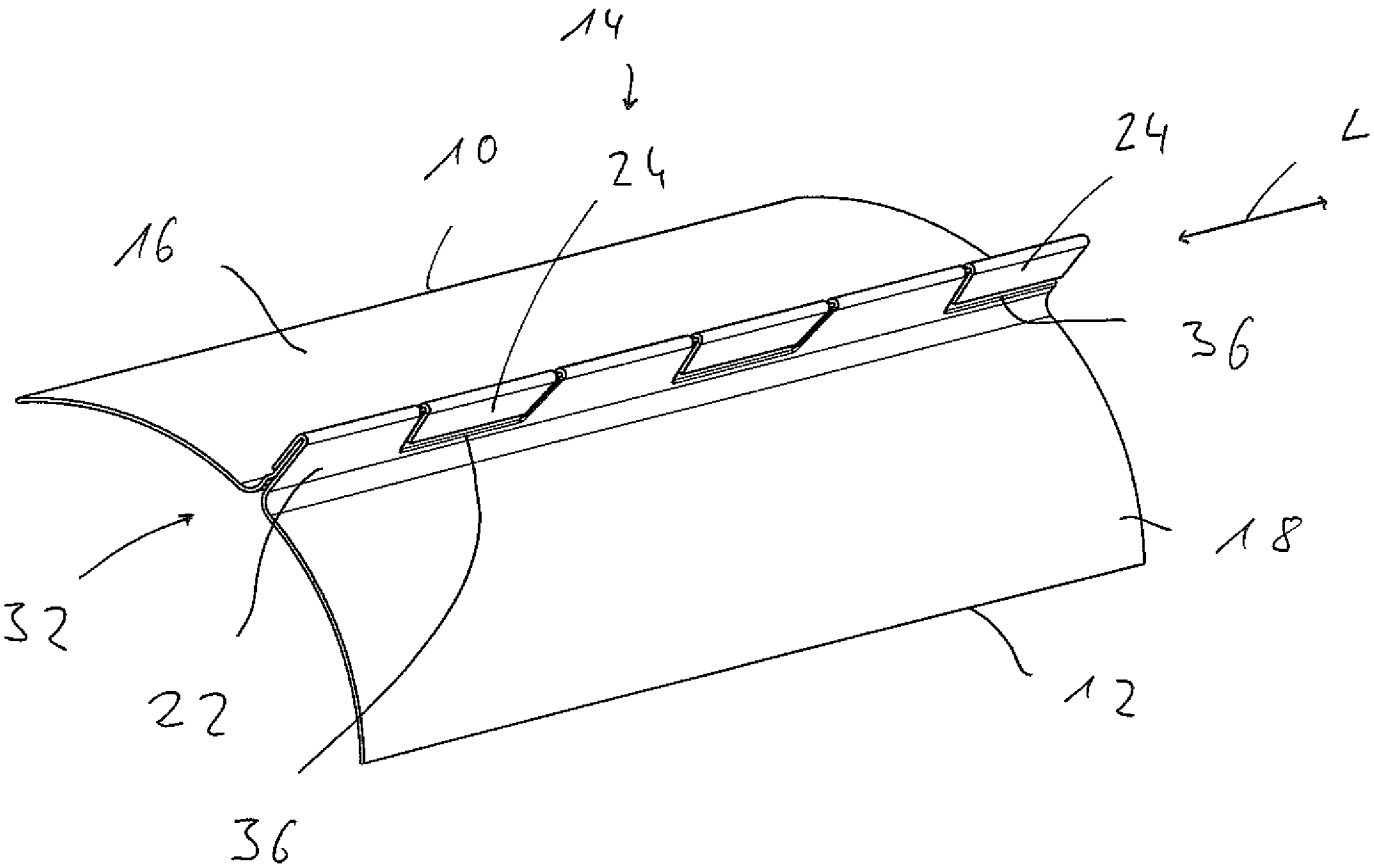
FIG. 5 is a perspective view, corresponding to the embodiment of FIG. 4, of the folded connection area, viewed in another direction.
Figure 6:
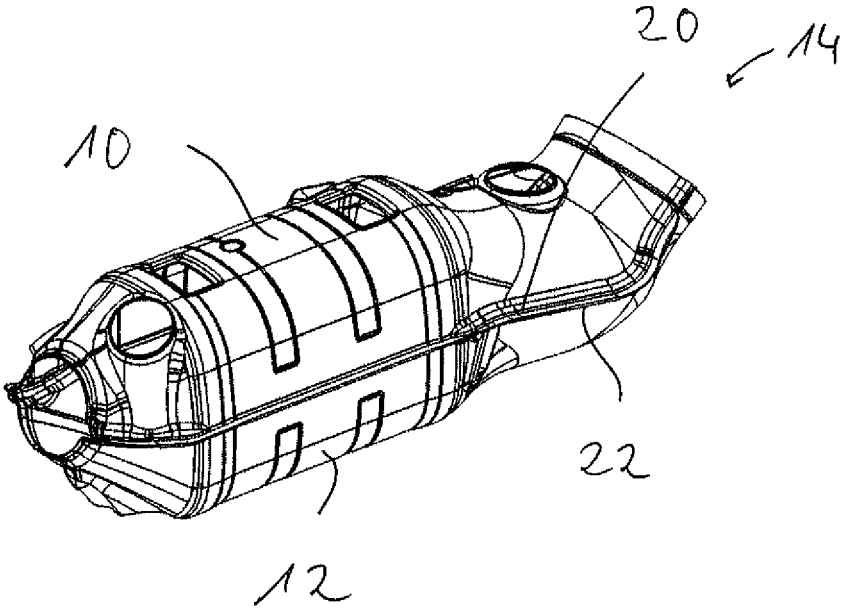
FIG. 6 is a perspective view of a housing of an exhaust gas treatment unit, which housing is configured with two housing shell areas.
Figure 7:
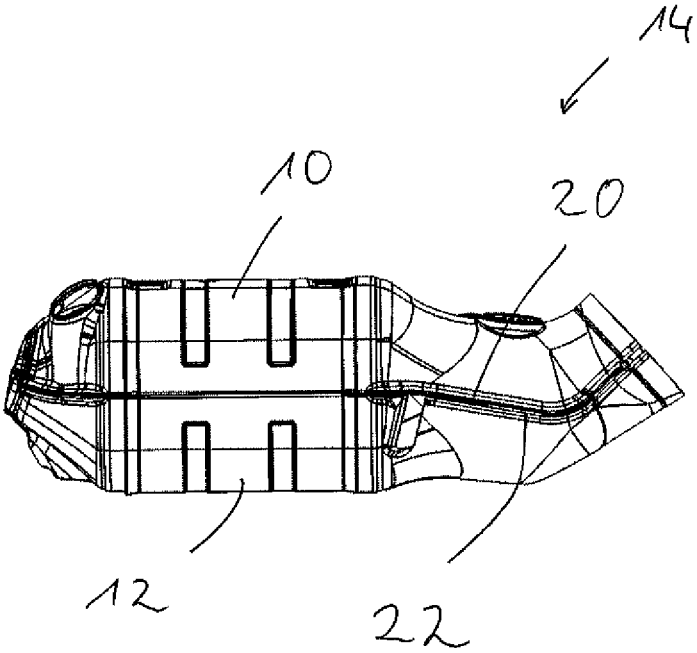
FIG. 7 is a lateral view of the housing according to the embodiment of FIG. 6.

The two folded edge areas 20, 22 have an essentially flatly contiguous configuration in the configuration described above with reference to FIGS. 1-3. The overall thickness of the of the folded connection area 32 in the configuration described above with reference to FIGS. 1-3 is four times a thickness of the sheet metal. This means that lateral bulges or lateral recesses, which will be described below with reference to FIGS. 4 and 5, are not present in any of these folded edge areas 20, 22. In addition, the folded edge areas 20, 22 of the embodiment shown in FIGS. 1-3 extend in a straight line. FIGS. 6 and 7 show a housing 14 of an exhaust gas treatment unit configured with two housing shell areas 10, 12, in which the two housing shell areas 10, 12 are likewise connected to one another in folded edge areas 20, 22, which likewise lack lateral bulges (or lateral recesses), i.e., they have an essentially flatly contiguous configuration in the above-described sense, but they do not extend in a straight line, but they extend curved in space. The connection of the two housing shell areas 10, 12 may also be carried out with the use of the above-described crimped sections in case of such a curved configuration of the folded edge areas 20, 22, which do, however, have, in principle, an essentially flat configuration.

An alternative type of embodiment of a housing 14 configured according to the present invention is shown in FIGS. 4 and 5. The two folded edge areas 20, 22 do not have a flatly contiguous configuration along the folded edge longitudinal axis L in this configuration. Crimped section mounting recesses 34, 36 are rather formed in each of the two folded edge areas 20, 22 in the folded edge longitudinal axis L between two crimped sections 24, 26 each associated with the respective intermediate spaces 28, 30 formed between them. The length of extension of these crimped section mounting recesses 34, 36, in the direction of the folded edge longitudinal axis L, corresponds essentially to the length of extension of a respective associated intermediate space 28, 30. The depth of these crimped section mounting recesses 34, 36, are prepared or formed by shaping the respective folded edge areas 20, 22, such that the depth of each mounting recesses 34, 36 corresponds essentially to a thickness or material thicknesses of the crimped sections 24, 26 to be received in them, so that these are received essentially completely in the associated crimped section mounting recesses 34, 36 of the respective folded edge areas 20, 22, after the further folding over or further crimping is performed to prepare the folded connection area 32. With the mounting recesses 34, 36 having a thickness reduced by half as compared to the thickness of the sheet metal by shaping the sheet metal of two housing shell areas 10, 12, at a region of the mounting recesses 34, 36, to form the mounting recesses 34, 36, the total thickness of the folded connection area 32 is three times the thickness of the sheet metal.

The total thickness of the folded connection area 32 may further be made to decrease in this type of configuration in relation to that of the embodiment according to FIGS. 1-3 by half. For example, a total thickness formed by the material thickness of the two housing shell areas 10, 12, at a region of the mounting recesses 34, 36, may be reduced by half by shaping the sheet metal of two housing shell areas 10, 12, at a region of the mounting recesses 34, 36, to form the mounting recesses 34, 36, having half the thickness of the remaining two housing shell areas 10, 12. Further the sheet metal of the crimped sections 24, 26 may be shaped to reduce the thickness of the crimped sections 24, 26 by half such that the thickness of the folded connection area 32 may be made to decrease with this configuration in relation to that of the embodiment according to FIGS. 1-3 by half. With this example, the final construction may be made to have an even surface at each side of the folded connection area 32. Other combinations of a reduced thickness at the folded edge shaped mounting recesses 34, 36 and a reduced thickness of the crimped sections 24, 26 may be provided.

A housing configured according to the principles of the present invention may be configured with two housing shells, which are connected in respective mutually adjoining housing shell areas with a folded connection area configured in the above-described manner. For example, such folded connection areas may be formed preferably in the direction of the housing longitudinal axis on two areas of the housing, which areas are located opposite each other in relation to a housing longitudinal axis. In case of a housing made of a single part, this part forming a housing shell may be bent in a ring-shaped configuration, so that the housing shell areas then adjoining each other can be connected to one another in a single folded connection area.

While specific embodiments of the invention have been shown and described in detail to illustrate the application of the principles of the invention, it will be understood that the invention may be embodied otherwise without departing from such principles.

What is claimed is:

1. A housing for an exhaust system of an internal combustion engine of a vehicle, the housing comprising:

a first housing shell area comprising a first housing shell folded edge area which extends along a first housing shell folded edge longitudinal axis and a plurality of a first housing shell crimped sections, each of the first housing shell crimped sections extending at right angles to the first housing shell folded edge longitudinal axis and away from the first housing shell folded edge area, each of the first housing shell crimped sections being arranged at spaced locations from one another to provide first housing shell intermediate spaces with each of the first housing shell intermediate spaces being in a direction along the first housing shell folded edge longitudinal axis, and each of the first housing shell intermediate spaces being adjacent to at least one of said first housing shell crimped sections;

a second housing shell area comprising a second housing shell folded edge area which extends along a second housing shell folded edge longitudinal axis and a plurality of second housing shell crimped sections, each of the second housing shell crimped sections extending at right angles to the second housing shell folded edge longitudinal axis and away from the second housing shell folded edge area, each of the second housing shell crimped sections being arranged at spaced locations from one another to provide second housing shell intermediate spaces, with each of the second housing shell intermediate spaces being in a direction along the second housing shell folded edge longitudinal axis, and each of the second housing shell intermediate spaces being adjacent to at least one of said second housing shell crimped sections; and a folded connection area formed by the first housing shell folded edge area, the second housing shell folded edge area, the first housing shell crimped sections and the second housing shell crimped sections, wherein at least some of the crimped sections of each of the housing shell areas mesh with a respective intermediate space formed between two crimped sections of the respective other housing shell area and overlaps the folded edge area of said respective other housing shell area whereby the folded edge area of said respective other housing shell area is held between the crimped sections overlapping same and the folded edge area of the housing shell area having the crimped sections, wherein in at least one housing shell area the folded edge area has a crimped section mounting recess associated with at least one intermediate space formed between crimped sections following each other along a direction of the folded edge longitudinal axis between the two crimped sections forming the intermediate space on a side facing away from the folded edge area of the respective other housing shell area.

2. A housing in accordance with claim 1, wherein in each housing shell area, the intermediate space formed between two crimped sections following each other along a direction of the folded edge longitudinal axis has a length of extension in the direction of the folded edge longitudinal axis that corresponds to a length of extension of the crimped sections of the respective other housing shell area, which said crimped section is received in this intermediate space.

3. A housing in accordance with claim 1, wherein a length of extension of each of the crimped sections corresponds to a length of extension of the respective intermediate space formed between crimped sections following each other along a direction of the folded edge longitudinal axis.

4. A housing in accordance with claim 1, wherein the crimped sections have a tapering configuration starting from the folded edge area in at least one housing shell area.

5. A housing in accordance with claim 1, wherein the folded edge area has an flatly contiguous configuration in all housing shell areas.

6. A housing in accordance with claim 1, wherein the folded edge area is bent in relation to a housing shell body adjoining the folded edge area in at least one housing shell area.

7. A housing in accordance with claim 1, wherein the housing shell areas are in contact with one another by folded edge areas thereof.

8. A housing in accordance with claim 1, wherein a length of extension of a respective crimped section mounting recess along the direction of the folded edge longitudinal axis corresponds to a length of extension of a crimped section received therein, or a depth of the recess of a respective crimped section mounting recess corresponds to a thickness of the crimped section received in the recess of a respective crimped section.

9. A housing in accordance with claim 8, wherein to provide a respective crimped section mounting recess, the folded edge area of one of the housing shell areas is deformed in the direction of the folded edge area of the respective other housing shell area.

10. A housing in accordance with claim 1, wherein at least one housing shell area is made from sheet metal material.

11. A housing in accordance with claim 10, wherein each housing shell area is made from sheet metal material.

12. An exhaust gas treatment unit for an exhaust system of an internal combustion engine, the exhaust gas treatment unit comprising a housing comprising:

a first housing shell area comprising a first housing shell folded edge area which extends along a first housing shell folded edge longitudinal axis and a plurality of a first housing shell crimped sections, each of the first housing shell crimped sections extending at right angles to the first housing shell folded edge longitudinal axis and away from the first housing shell folded edge area, each of the first housing shell crimped sections being arranged at spaced locations from one another to provide first housing shell intermediate spaces with each of the first housing shell intermediate spaces being in a direction along the first housing shell folded edge longitudinal axis, and each of the first housing shell intermediate spaces being adjacent to at least one of said first housing shell crimped sections;

a second housing shell area comprising a second housing shell folded edge area which extends along a second housing shell folded edge longitudinal axis and a plurality of second housing shell crimped sections, each of the second housing shell crimped sections extending at right angles to the second housing shell folded edge longitudinal axis and away from the second housing shell folded edge area, each of the second housing shell crimped sections being arranged at spaced locations from one another to provide second housing shell intermediate spaces, with each of the second housing shell intermediate spaces being in a direction along the second housing shell folded edge longitudinal axis, and each of the second housing shell intermediate spaces being adjacent to at least one of said second housing shell crimped sections; and a folded connection area formed by the first housing shell folded edge area, the second housing shell folded edge area, the first housing shell crimped sections and the second housing shell crimped sections, wherein at least some of the crimped sections of each of the housing shell areas mesh with a respective intermediate space formed between two crimped sections of the respective other housing shell area and overlaps the folded edge area of said respective other housing shell area whereby the folded edge area of said respective other housing shell area is held between the crimped sections overlapping same and the folded edge area of the housing shell area having the crimped sections, wherein in at least one housing shell area the folded edge area has a crimped section mounting recess associated with at least one intermediate space formed between crimped sections following each other along a direction of the folded edge longitudinal axis between the two crimped sections forming the intermediate space on a side facing away from the folded edge area of the respective other housing shell area.

13. An exhaust gas treatment unit in accordance with claim 12, wherein a length of extension of each of the crimped sections corresponds to a length of extension of the respective intermediate space formed between crimped sections following each other along a direction of the folded edge longitudinal axis.

14. An exhaust gas treatment unit in accordance with claim 12, wherein the crimped sections have a tapering configuration starting from the folded edge area in at least one housing shell area.

15. An exhaust gas treatment unit in accordance with claim 12, wherein a length of extension of a respective crimped section mounting recess along the direction of the folded edge longitudinal axis corresponds to a length of extension of a crimped section received therein, or a depth of the recess of a respective crimped section mounting recess corresponds to a thickness of the crimped section received in the recess of a respective crimped section.

16. An exhaust gas treatment unit in accordance with claim 15, wherein:

each housing shell area is made from sheet metal material; and to provide a respective crimped section mounting recess, the folded edge area of one of the sheet metal material of the housing shell areas are deformed in the direction of the folded edge area of the respective other housing shell area.

17. An exhaust system treatment unit housing comprising:

a first housing shell comprising a first housing shell area comprising a first housing shell folded edge area which extends along a first housing shell course and a plurality of a first housing shell crimped sections extending from the first housing shell folded edge and arranged at spaced locations from one another along at least a portion of the first housing shell course and with a plurality of first housing shell intermediate spaces with the first housing shell intermediate spaces arranged at spaced locations from one another along at least a portion of the first housing shell course with each of the first housing shell intermediate spaces being adjacent to at least one of said first housing shell crimped sections;

a second housing shell comprising a second housing shell area comprising a second housing shell folded edge area which extends along a second housing shell course and a plurality of a second housing shell crimped sections extending from the second housing shell folded edge and arranged at spaced locations from one another along at least a portion of the second housing shell course and with a plurality of second housing shell intermediate spaces with the second housing shell intermediate spaces arranged at spaced locations from one another along at least a portion of the second housing shell course with each of the second housing shell intermediate spaces being adjacent to at least one of said second housing shell crimped sections; and a folded connection connecting the first housing shell to the second housing shell, the folded connection comprising the first housing shell folded edge area, the second housing shell folded edge area, the first housing shell crimped sections and the second housing shell crimped sections, wherein:

a connection surface of the first housing shell folded edge area is positioned adjacent to a connection surface of the second housing shell folded edge area;

the first housing shell folded edge area has an opposite first folded edge surface, opposite to the connection surface of the first housing shell folded edge area, the opposite first folded edge surface having a plurality of first folded edge shaped mounting recesses positioned to receive a respective one of the second housing shell crimped sections;

the second housing shell folded edge area has an opposite second folded edge surface, opposite to the connection surface of the second housing shell folded edge area, the opposite second folded edge surface having a plurality of second folded edge shaped mounting recesses positioned to receive a respective one of the first housing shell crimped sections;

each of the plurality of a first housing shell crimped sections is aligned, along the first housing shell course, with one of the second housing shell intermediate spaces;

each of the plurality of second housing shell crimped sections is aligned, along the second housing shell course, with one of the second housing shell intermediate spaces;

each of the plurality of a first housing shell crimped sections engages one of the second folded edge shaped mounting recesses and has a connection surface positioned adjacent to the opposite second folded edge surface to clamp the second housing shell folded edge area between the first housing shell crimped sections and the first housing shell folded edge area; and each of the plurality of a second housing shell crimped sections engages one of the first folded edge shaped mounting recesses and has a connection surface positioned adjacent to the opposite first folded edge surface, to clamp the first housing shell folded edge area between the second housing shell crimped sections and the second housing shell folded edge area.

18. An exhaust gas treatment unit housing in accordance with claim 17, wherein the crimped sections have a tapering configuration starting from the folded edge area.

19. A method for forming a housing of an exhaust system of an internal combustion engine of a vehicle, the method comprising the steps of:

providing a first housing shell area comprising a first housing shell folded edge area which extends along a first housing shell folded edge longitudinal axis and a plurality of a first housing shell crimped sections, each of the first housing shell crimped sections extending at right angles to the first housing shell folded edge longitudinal axis and away from the first housing shell folded edge area, each of the first housing shell crimped sections being arranged at spaced locations from one another to provide first housing shell intermediate spaces with each of the first housing shell intermediate spaces being in a direction along the first housing shell folded edge longitudinal axis, and each of the first housing shell intermediate spaces being adjacent to at least one of said first housing shell crimped sections, the first housing shell folded area having a first folded edge shaped mounting recess associated with each one of the intermediate spaces formed between the first housing shell crimped sections following each other in the direction of the first housing shell folded edge longitudinal axis;

providing a second housing shell area comprising a second housing shell folded edge area which extends along a second housing shell folded edge longitudinal axis and a plurality of second housing shell crimped sections, each of the second housing shell crimped sections extending at right angles to the second housing shell folded edge longitudinal axis and away from the second housing shell folded edge area, each of the second housing shell crimped sections being arranged at spaced locations from one another to provide second housing shell intermediate spaces, with each of the second housing shell intermediate spaces being in a direction along the second housing shell folded edge longitudinal axis, and each of the second housing shell intermediate spaces being adjacent to at least one of said second housing shell crimped sections, the second housing shell folded area having a second folded edge shaped mounting recess associated with each one of the intermediate spaces formed between the second housing shell crimped sections following each other in the direction of the second housing shell folded edge longitudinal axis; and providing a folded connection area formed by the first housing shell folded edge area, the second housing shell folded edge area, the first housing shell crimped sections and the second housing shell crimped sections, wherein at least some of the crimped sections of each of the housing shell areas mesh with a respective intermediate space formed between two crimped sections of the respective other housing shell area and overlaps the folded edge area of said respective other housing shell area in the area of the respective folded edge shaped mounting recesses provided therein, whereby the folded edge area of said respective other housing shell area is held between the crimped sections overlapping same and the folded edge area of the housing shell area having the crimped sections.

* * * * *